United States Patent [19]

Konishi et al.

[11] Patent Number: 4,660,369

[45] Date of Patent: Apr. 28, 1987

[54] BOBBIN TRANSPORTING SYSTEM

[75] Inventors: Yuji Konishi, Oumihachiman; Tetsuo Inoue, Kyoto, both of Japan

[73] Assignee: Murata Kikai Kabushiki Kaisha, Kyoto, Japan

[21] Appl. No.: 692,057

[22] Filed: Jan. 15, 1985

[30] Foreign Application Priority Data

Jan. 21, 1984 [JP] Japan ..... 59-8683
Jan. 24, 1984 [JP] Japan ..... 59-10698

[51] Int. Cl.[4] ..... D01H 9/18; B65H 67/06

[52] U.S. Cl. ..... 57/281; 57/1 R; 57/276; 198/346.1; 198/346.2; 198/577; 242/35.5 R; 242/35.5 A

[58] Field of Search ..... 57/266, 268, 276, 281, 57/1 R, 90; 242/35.5 R, 35.5 A; 198/346.1, 346.2, 487.1, 577, 803.12

[56] References Cited

U.S. PATENT DOCUMENTS

| | | | |
|---|---|---|---|
| 3,195,298 | 7/1965 | Furst | 242/35.5 R X |
| 3,608,293 | 9/1971 | Brouwer | 57/281 |
| 3,828,682 | 8/1974 | Klein | 57/281 X |
| 3,884,026 | 5/1975 | Yoshizawa et al. | 57/281 |
| 4,041,686 | 8/1977 | Inaba et al. | 57/281 |
| 4,432,198 | 2/1984 | D'Agnolo | 242/35.5 R X |

*Primary Examiner*—John Petrakes
*Attorney, Agent, or Firm*—Spensley Horn Jubas & Lubitz

[57] ABSTRACT

A bobbin transporting system in which a winder area and a spinning frame area having a plurality of spinning frames are connected to each other by means of a spinning bobbin transporting line and an empty bobbin transporting line. Transport bands for spinning bobbins are located along opposite sides of the spinning frame and are circulated in integral relationship so that spinning bobbins are delivered at the same time from the transport bands to the spinning bobbin transporting line and supplied to the winder.

12 Claims, 24 Drawing Figures

BOBBIN TRANSPORTING SYSTEM

BACKGROUND OF THE INVENTION

The present invention relates to a bobbin transporting system, and more particularly to a system for transporting spinning bobbins produced by spinning frames and empty bobbins discharged from a winder and returned to the spinning frames which are connected to the winder.

A spinning frame, especially a ring spinning frame, is normally constituted such that a number of fine spinning spindles are arranged in rows along a longitudinal direction on opposite sides of a machine stand of the spinning frame. In such a spinning frame, a transport band is mounted for circulation along each of the spindle rows so that spinning bobbins doffed may be automatically fitted onto pegs on the transport band and as the transport band is circulated, they may be dropped and delivered, at an end portion of the transport band, into a bobbin box located on one side of the transport band. The bobbin box filled with spinning bobbins is transported to the winder side by means of a bogie truck, a conveyor or the like and is supplied at a suitable time to an automatic spinning bobbin supplying device of the winder. In other words, a spinning frame and a winder are not directly connected to each other, and hence spinning bobbins are supplied in a batch to the winder by way of a bobbin box.

While such a transporting system is suitable for production of yarns of a same type in a large quantity, but since spinning bobbins are contained at random in a box and are transported in this condition, the system is disadvantageous in that a surface of a yarn layer is damaged in configuration, hairiness is produced in a large quantity, and so on.

Meanwhile, distinct from the transporting system, a fine spinning winder in which a spinning frame and a winder is directly connected to each other by means of a bobbin transporting path is proposed and run as a system which is suitable for production of a number of types of products in small quantities. In particular, in one type, spinning bobbins delivered from a transport band of a spinning frame are directly transported to a winder by means of a conveyor belt, while in another type, spinning bobbins are directly supplied to a spinning bobbin supplying device of a winder from an end of a transport band. In this way, a spinning frame and a winder are directly interconnected on line by a belt conveyor or the like.

In such a case, a problem is that a yarn processing capacity of a winder must be balanced with a supplying capacity of spinning bobbins delivered from a spinning frame connected to the winder. In particular, if the spinning bobbin delivering speed of the spinning frame side is lower than the bobbin consuming speed of the winder, a waiting time will appear to the winder. Particularly where a winder having a high speed winding feature is installed for an already installed spinning frame, the problem described just above will rise readily.

A requirement for a system for automatically transporting bobbins between a spinning frame and a winder to operate efficiently is that a capacity of the spinning frame to produce yarns is balanced with a facility of the winder to work yarns, or in other words, when each machine is operated without any trouble, spinning bobbins are supplied to the winder while empty bobbins are returned to the spinning frame without any waiting time caused in the spinning frame or the winder.

Generally, a yarn production speed of a spinning frame is lower than a rewinding speed of a winder so that, if a spinning frame having 400 spindles is provided for a winder having 10 spindles, then the production speeds of them may match to each other.

Accordingly, it may be appropriate to connect the winder having 10 spindles directly to the spinning frame having 400 spindles. However, in a factory in which a number of spinning frames are installed, winders must also be installed by a corresponding large number, and a driving source, a yarn end finder and so on must necessarily be provided for each of the winders. Thus, such a system is uneconomical.

Accordingly, it is common to provide a plurality of spinning frames for a winder. For example, four spinning frames each having 400 spindles are connected to a winder having 40 spindles by means of an automatic transporting path such that spinning bobbins produced on the spinning frames are supplied to the single winder while empty bobbins discharged from the winder are distributed and returned to the plurality of spinning frames.

Meanwhile, another system is provided wherein means for transporting spinning bobbins doffed by spinning frames includes a transport band which extends and is circulated along the spinning frames and has thereon pegs on which spinning bobbins are fitted, whereby the transport band is circulated intermittently and spinning bobbins are transferred onto a spinning bobbin transporting conveyor from a forward end of the spinning frames while empty bobbins are supplied onto empty pegs of the transport band at a rearward end of the spinning bobbins so as to allow discharging of spinning bobbins from the transport band and fitting of empty bobbins onto the transport band to be effected during circulation of the transport band in one direction. In this case, supply of a spinning bobbin to the winder and return of an empty bobbin to the spinning frames correspond to and is balanced with other. Thus, there is no problem to this method.

In the meantime, there is another arrangement which is similar in that spinning bobbins on the spinning frame side are transported by means of a transport band but wherein a position at which empty bobbins are supplied onto the transport band is on the same side with the spinning bobbin delivering side.

For example, an arrangement as disclosed in Japanese Publication Pat. No. 43-29208 is of a type wherein a conveyor belt extending along spinning frames is circulated back and forth such that after spinning bobbins have been discharged from the belt at an end portion thereof, the belt is circulated reversely while empty bobbins are supplied onto the belt in this intermittent circulating movement of the belt. In this arrangement, while spinning bobbins are being discharged, empty bobbins returned from a winder cannot be supplied onto the belt. Accordingly, it is necessary to provide an empty bobbin stock device intermediate an empty bobbin returning path. In order to store empty bobbins for one spinning frame, for example, up to 200 empty bobbins for one side of the spinning frame having 400 spindles as in the example above, a large stock space is required. Besides, since each empty bobbin has a somewhat tapered configuration in order to facilitate releasing of a yarn therefrom, if such empty bobbins are stored in a large quantity, then they may be oriented in different directions. This makes it very disadvantageous to design an automatic transporting system.

SUMMARY OF THE INVENTION

An object of the present invention is to provide a bobbin transporting system wherein a winder and spinning frames are connected by bobbin transporting lines and a capacity of the spinning frame to produce spinning bobbins is balanced with a facility of the winder to wind up yarns.

A system of the present invention is constituted such that transport bands on opposite sides of a spinning frame stand are circulated in integral relationship whereby spinning bobbins are delivered one from an end of each of the transport bands and hence two spinning bobbins are delivered at the same time to an spinning bobbin transporting line which is connected to a winder.

Furthermore, the present invention provides a bobbin transporting system wherein a winder area and a spinning frame area having a plurality of spinning frames therein are interconnected to each other by means of a spinning bobbin transporting line and an empty bobbin transporting line such that returning of an empty bobbin to a designated one of the spinning frames in the spinning frame area is effected while spinning bobbins doffed from any other designated spinning frames except the designated spinning frame are being delivered onto the spinning bobbin transporting line.

BRIEF DESCRIPTION OF THE DRAWINGS

FIGS. 21-1 to 21-3 are a flowchart illustrating the controlling operations of the sequencing circuit of FIGS. 18 to 20.

DETAILED DESCRIPTION OF THE INVENTION

Now, an embodiment of the present invention will be described with reference to the drawings.

Figure 1:
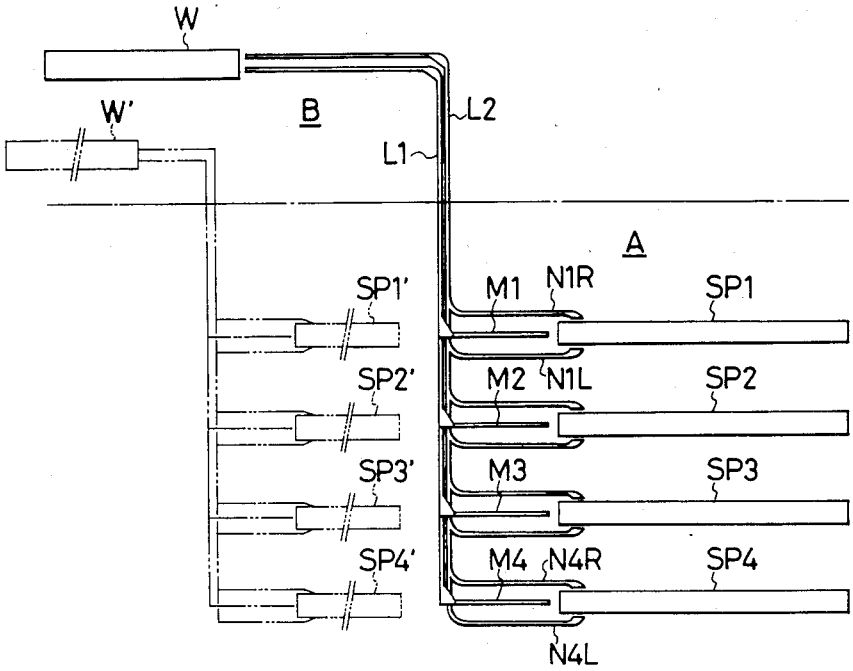
FIG. 1 is a plan view, in diagrammatic representation, of a bobbin transporting line constituting a system of the present invention.
Figure 2:
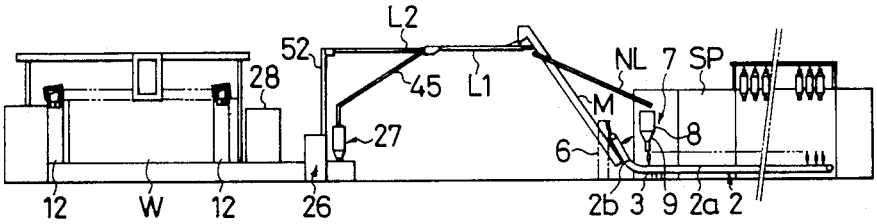
FIG. 2 is a front elevational view of the bobbin transporting line of FIG. 1.

FIGS. 1 and 2 illustrate an arrangement of four spinning frames SP1 to SP4 and a single winder W. The spinning frames SP1 to SP4 are arranged in parallel relationship and constitute a spinning frame area A. While a winder area B is constituted with a single winder in the embodiment, if a production capacity of each of the spinning frames SP1 to SP4 is otherwise doubled, then a winder area may include two winders.

A spinning bobbin transporting main line L1 and an empty bobbin transporting main line L2 extend between the spinning frame area A and the winder area B and may be formed from a conveyor, a chute and so on as hereinafter described. Joined to the spinning bobbin transporting main line L1 are spinning bobbin delivering lines M1 to M4 provided for the spinning frames SP1 to SP4, respectively.

Formed from the empty bobbin transporting main line L2 are branch lines N1R and N1L to N4R and N4L for returning empty bobbins to R stands and L stands of the spinning frames SP1 to SP4.

Accordingly, spinning bobbins on which yarns produced on the spinning frames SP1 to SP4 have been wound up are delivered from the delivering lines M1 to M4 onto the main line L1 and are transported and supplied by the same to the winder W area. Empty bobbins from which yarns have been unwound by the winder W and hence which have no yarn layers thereon are transported on the main transporting line L2 so that they are returned to the spinning frame area A and thus to predetermined spinning frames in a manner as hereinafter described. In this manner, bobbins are transported and circulated between the spinning frames and the winder as media for carrying yarns produced on the spinning frames one after another to the winder.

Figure 3:
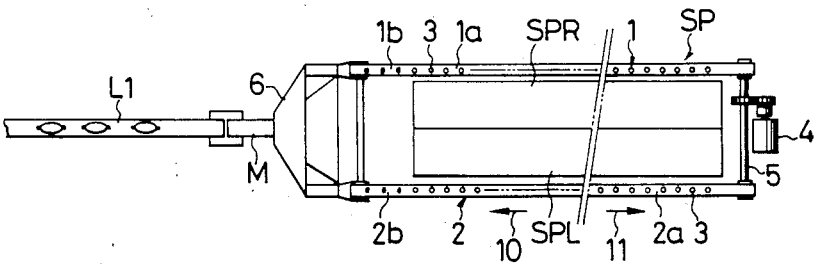
FIG. 3 is a plan view, in diagrammatic representation, of a spinning bobbin delivery device of a spinning frame.
Figure 4:
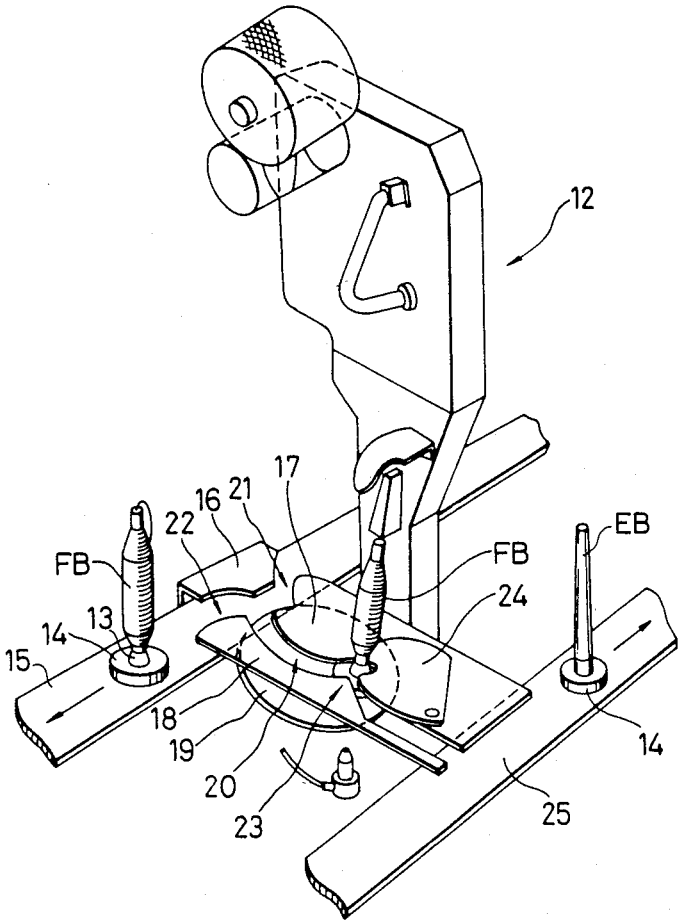
FIG. 4 is a perspective view, in diagrammatic representation, illustrating an example of a winding unit of a winder which may be applied to a system of the invention.

An example of an arrangement of the spinning frames SP and the winder W is diagrammatically shown in FIG. 2 to 4. It is to be mentioned that the spinning frames SP1 to SP4 are designated SP as a whole. In FIGS. 2 and 3, each of the spinning frames SP is constituted from an R stand (SPR) and an L stand (SPL) arranged in back to back relationship, and transport bands 1 and 2 are disposed for circulation in back and forth directions along a lengthwise direction of and on opposite sides of the machine stands.

In particular, each of the transport bands 1 and 2 has bobbin fitting pegs 3 implanted in the same pitch with the pitch of spindles of the spinning frame and are operated commonly from a driving source 4 and a drive shaft 5. The transport bands 1 and 2 have horizontal portions 1*a* and 2*a* extending along the machine stands and inclined portions 1*b* and 2*b* around an end of the machine stands. Thus, two spinning bobbins on the transport bands 1 and 2 are delivered at a time from upper ends of the inclined portions 1*b* and 2*b* into a guide chute 6 device which will be described hereinafter. Further, provided on the delivering side of the transport bands is an empty bobbin supplying station 7 for supplying empty bobbins onto the bands from which spinning bobbins have been delivered. The empty bobbin supplying station 7 includes an empty bobbin box 8 which can reserve therein a plurality of empty bobbins returned from the winder, and an empty bobbin fitting device 9 which releases empty bobbins one after another from the box 8 and fits them onto pegs on the transport bands. An arrow mark 10 in FIG. 3 illustrates a circulating direction of the transport bands 1 and 2 upon delivering of spinning bobbins while another arrow mark 11 illustrates a circulating direction of them upon supplying of empty bobbins.

FIGS. 2 and 4 illustrate an example of the winder. The winder W is constituted from a plurality of winding units 12 disposed in juxtaposed relationship as shown in FIG. 4. Thus, spinning bobbins FB are carried on a belt 15 circulating along one side of the winder while they are held fitted on carriers 14 each having a bobbin fitting peg 13 formed on a disk member so that they may be automatically supplied to one of the winding units 12 which has an empty area in a bobbin stand-by guideway thereof. In particular, if a spinning bobbin is transferred onto a disk 19 by way of an inlet gate 21 and is thus admitted into and supplied to a stand-by guideway 20 formed by guide plates 16, 17 and 18 and a rotary disk 19 below. If a predetermined number of spinning bobbins are stored in the stand-by guideway 20, succeeding bobbins will not be admitted by the winding unit and hence will be sent out by way of an exit gate 22 to a next one of the winding units which has an empty area for a spinning bobbin.

Meanwhile, after a yarn has been unwound from a spinning bobbin FB at a winding position 23 of a winding unit 12, as a discharging lever 24 is operated in response to an instruction from the winding unit, the thus emptied bobbin is discharged onto an empty bobbin transporting belt 25 while it is held fitted on the carrier 14. Consequently, as the belt 25 is circulated, the empty bobbin will be transported for a subsequent next step. It is to be noted that reference numeral 26 in FIG. 2 designates a station in which empty bobbins transported thereto by the carriers are removed from the carriers and an empty bobbin thus removed by means of a bobbin clamping device mounted for up and down pivotal motion is carried back to the spinning frame side by way of the empty bobbin transporting line L2. Meanwhile, an empty carrier from which an empty bobbin has been removed is fed to a position of a spinning bobbin supplying station 27 and is supplied with a spinning bobbin there. The carrier is then fed to a yarn end finding station 28 and then supplied to any of the winding units of the winder as illustrated in FIG. 4.

It is to be noted that the winder may be of any other type, for example, of the type wherein each of winding units has a spinning bobbin storing magazine provided in front thereof to which spinning bobbins are automatically supplied by means of a conveyor, a truck or the line.

Now, description will be given of components of the bobbin transporting lines.

Figure 5A:
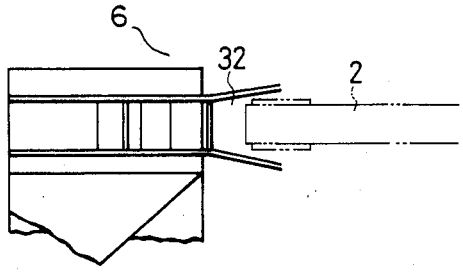
FIG. 5*a* is a plan view showing a guide device which is used in delivering spinning bobbins on a transport band onto a delivery conveyor.
Figure 5B:
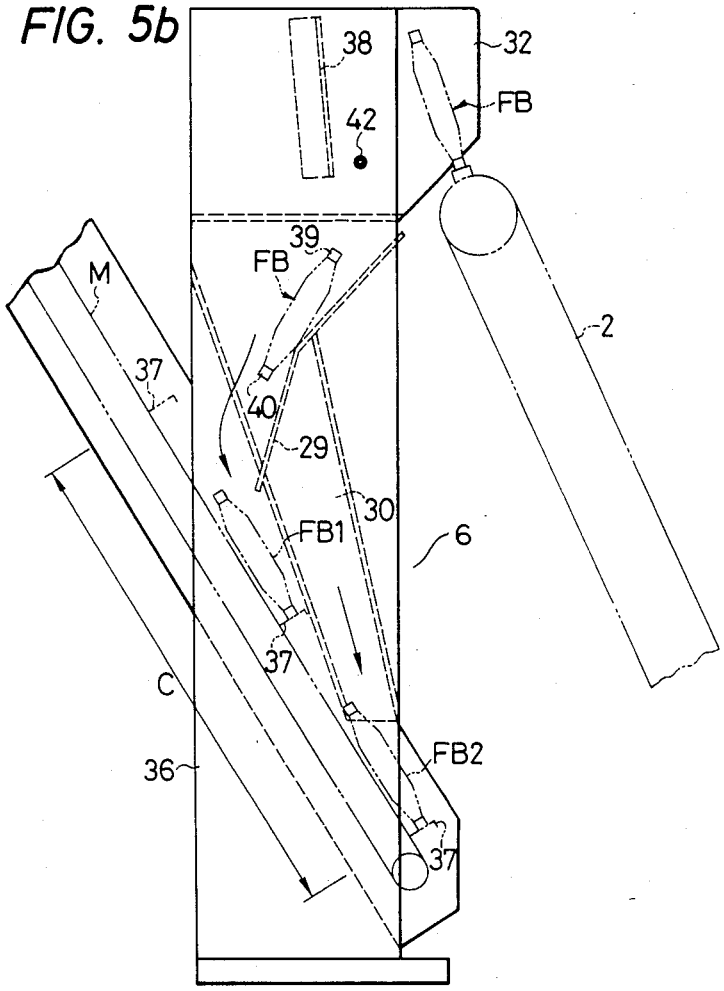
FIG. 5*b* is a front elevational view of the device shown in FIG. 5*a;*
Figure 6:
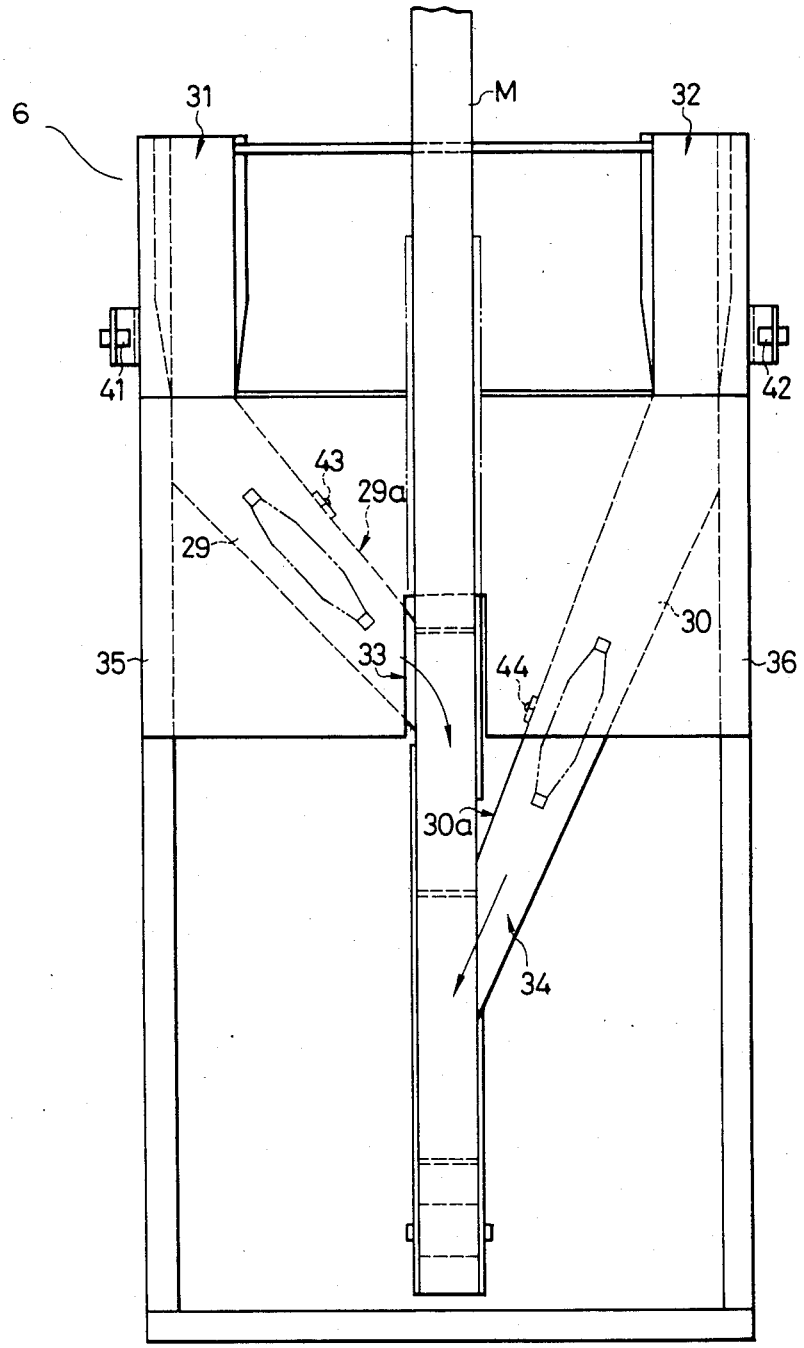
FIG. 6 is a side elevational view of the device of FIG. 5.

FIGS. 5*a*, 5*b* and 6 device 6 illustrate a guide chute and an inclined delivering conveyor for a spinning bobbin delivered from the transport bands on the opposite sides of the spinning frames SP1 to SP4. In particular, guide chute 6 contains inlet gates 31 and 32 of chutes 29 and 30 which are located contiguously to upper ends of the inclined portions of the transport bands 1 and 2 and which are located in a spaced relationship from each other by the same distance with that between the transport bands 1 and 2. Openings 33 and 34 at lower ends of the chutes are located at positions of a delivering conveyor M spaced by one pitch in a vertical direction. The delivering conveyor M extends substantially in the center between the inlet gates 31 and 32 of the chutes 29 and 30, that is, in the center between frame members 35 and 36, and is circulated in an inclined upward direction. The conveyor M has spinning bobbin lifting pins or plates 37 secured to an upper face thereof in an equally spaced relationship by a distance corresponding at least to the length of a spinning bobbin. Further, an orientation controlling plate 38 for a spinning bobbin is secured in the neighborhood of an entrance of each of the chutes so that a spinning bobbin may be contacted at a head 39 thereof with the controlling plate 38. As a result, the spinning bobbin is dropped along the chute 29 or 30 with a bottom portion 40 thereof directed downwardly. Reference numerals 41 and 42 designate each a photoelectric sensor which judges, when a beam of light passing the chutes is intercepted by a spinning bobbin or bobbins upon dropping in the chutes, that the delivering conveyor has received thereon normally two spinning bobbins, and in some cases, a single spinning bobbin, and develops a signal for circulating the conveyor M by one stroke. Here, the one stroke means a distance C as illustrated in FIG. 5*b* which is at least greater than the total length of two spinning bobbins FB1 and FB2. It is to be noted that upper plates 29*a* and 30*a* adjacent opening portions at lower ends of the chutes 29 and 30 shown in FIG. 6 are each mounted for opening and closing motion by means of a hinge 43 or 44 in order to facilitate removal of a spinning bobbin by opening the upper plate 29*a* or 30*a* when jamming is caused by bobbins.

Figure 7:
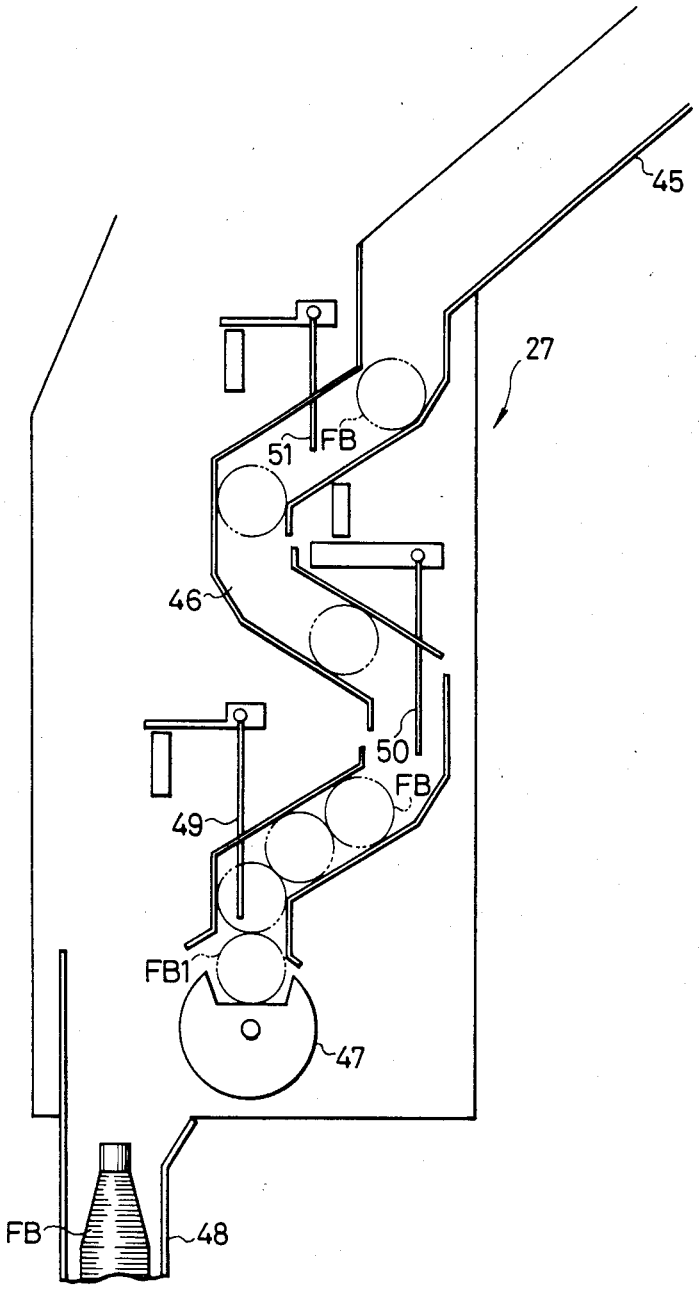
FIG. 7 is a view illustrating an example of a spinning bobbin supplying device on the winder side.

Accordingly, spinning bobbins delivered onto the delivering conveyor M are intermittently fed by two toward the main transporting line L1 above. Spinning bobbins FB delivered from the spinning frames SP1 to SP4 in this manner are fed in the same orientation on the spinning bobbin transporting main line L1 until they pass through a chute 45 and are stored in a predetermined quantity in the spinning bobbin supplying device 27. The spinning bobbin supplying device 27 is not limited to any particular type and an arrangement, for example, as shown in FIG. 7 may be employed therefor.

In particular, the spinning bobbin supplying device 27 may include a hopper 46 for storing a predetermined number of spinning bobbins therein, a releasing device 47 located contiguously to an opening at a lower end of the hopper 46, a guide chute 48 for guiding a bobbin onto a bobbin carrier at a stand-by position below, and so on, and each time a carrier reaches a bobbin receiving position, the releasing device 47 operates one cycle to release a spinning bobbin FB1. Feelers 49, 50 and 51 may be disposed at suitable positions intermediate a zigzag-formed stock path within the hopper 46 in order to detect presence or absence of a bobbin at any of the positions adjacent the feelers. For example, if the feeler 49 detects absence of a bobbin, the releasing device on the winder side is stopped into a stand-by position, and then if a bobbin has left the feeler 51 and then a few further bobbins have been reduced, a spinning bobbin demanding instruction is delivered to the spinning frame side. In response to this signal, the spinning bobbin transporting line is rendered operative so that spinning bobbins are supplied to the hopper, then if spinning bobbins are fed in to reach the feeler 51, the signal is stopped. Meanwhile, when spinning bobbins are not supplied for a long time after demanding for a spinning bobbin has been issued, that is, when spinning bobbins are reduced to a level of the feeler 50, a signal for checking delivering conveyors on the spinning frame side and other transporting paths on the spinning frame side is developed.

Now, description will be given of the line L2 for feeding empty bobbins from the winder side back to the spinning frame side.

Referring to FIG. 2, empty bobbins discharged from the winding units 12 of the winder W are fed to the bobbin removing station 26 while held fitted on carriers. Then, at the bobbin removing station 26, the bobbins pulled off the carriers by the aforementioned bobbin clamping and releasing member which are moved up and down are fed to the empty bobbin transporting main line L2 installed above by means of the lifting conveyor 52.

The main line L2 is a line constituted from a belt conveyor extending to the spinning frame area as shown in FIG. 1, and is connected to the branch lines N1R to N4L at positions adjacent the spinning frames SP1 to SP4 each by way of a movable guide which will be described hereinafter.

Figure 8:
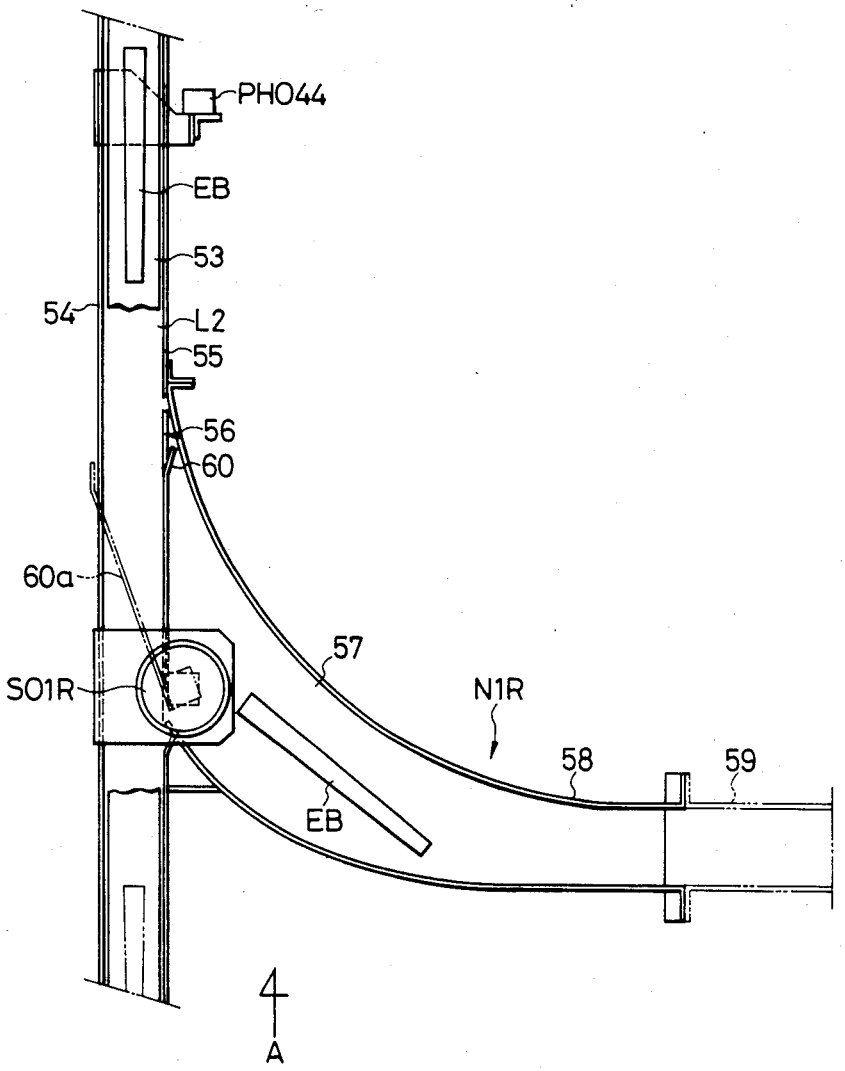
FIG. 8 is a plan view illustrating branch lines which connect an empty bobbin transporting main line to individual spinning frames.
Figure 9:
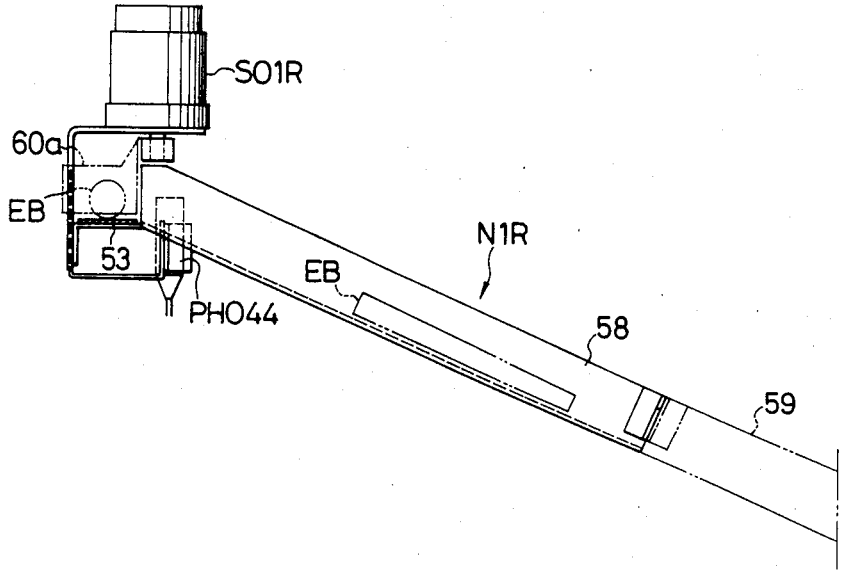
FIG. 9 is a view as viewed in a direction of an arrow mark A in FIG. 8.

Connections of the branch lines to the main line will be now described with reference to FIGS. 8 to 11. FIGS. 8 and 9 illustrate a representative one of connections of the branch lines N1R to N4R while FIGS. 10 and 11 illustrates a connection of the last branch line N4L.

Referring to FIGS. 8 and 9, the main line L2 includes a conveyor 53 and guide plates 54 and 55 on opposite sides of the conveyor 53, and a recess 56 is formed in a guide plate at a position adjacent the branch line N1R. The branch line N1R is inclined downwardly and includes an inlet chute 58 having a curved portion 57, and a guide chute 59 contiguous to the inlet chute 58 and extending to a position adjacent a bobbin stocker for the spinning frame. Provided at the connecting portion is a movable guide 60 which is shifted between two positions by means of a rotary solenoid SO1R. In particular, when the movable guide 60 is in a full line position 60, empty bobbins EB on the line L2 will pass by the chute 58 without being taken into the same, and only when the movable guide 60 is otherwise in a phantom position 60*a*, empty bobbins EB will be taken into the chute 58.

The movable guide 60 is operated to open and close in response to outputs from a sensor PH044 located directly before the guide 60 and a controlling device which receives and processes a signal from the sensor. The sensor and the controlling device have another function to prevent, when the movable guide 60 is shifted from the full line position 60 to the phantom position 60*a*, an empty bobbin on the conveyor from being clamped between the guide plate 54 and the movable guide 60 and thus blocks operation of the rotary solenoid until an empty bobbin is reached after a preceding empty bobbin has passed the position of the sensor PH044.

Figure 11:
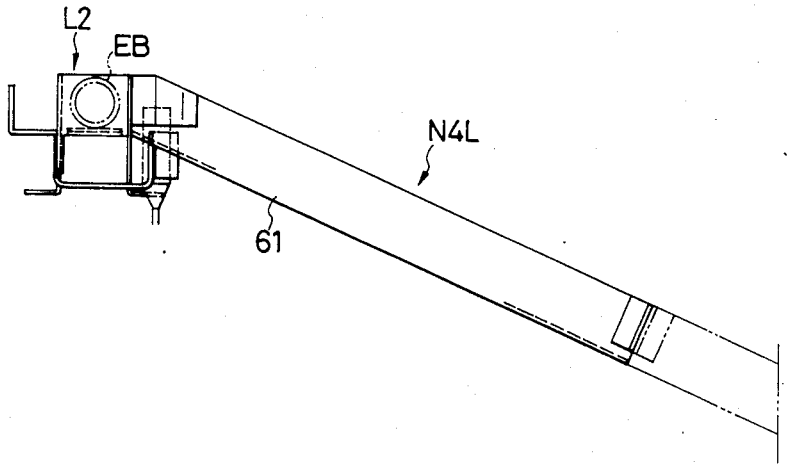
FIG. 11 is a view as view in a direction of an arrow mark B in FIG. 10.
Figure 10:
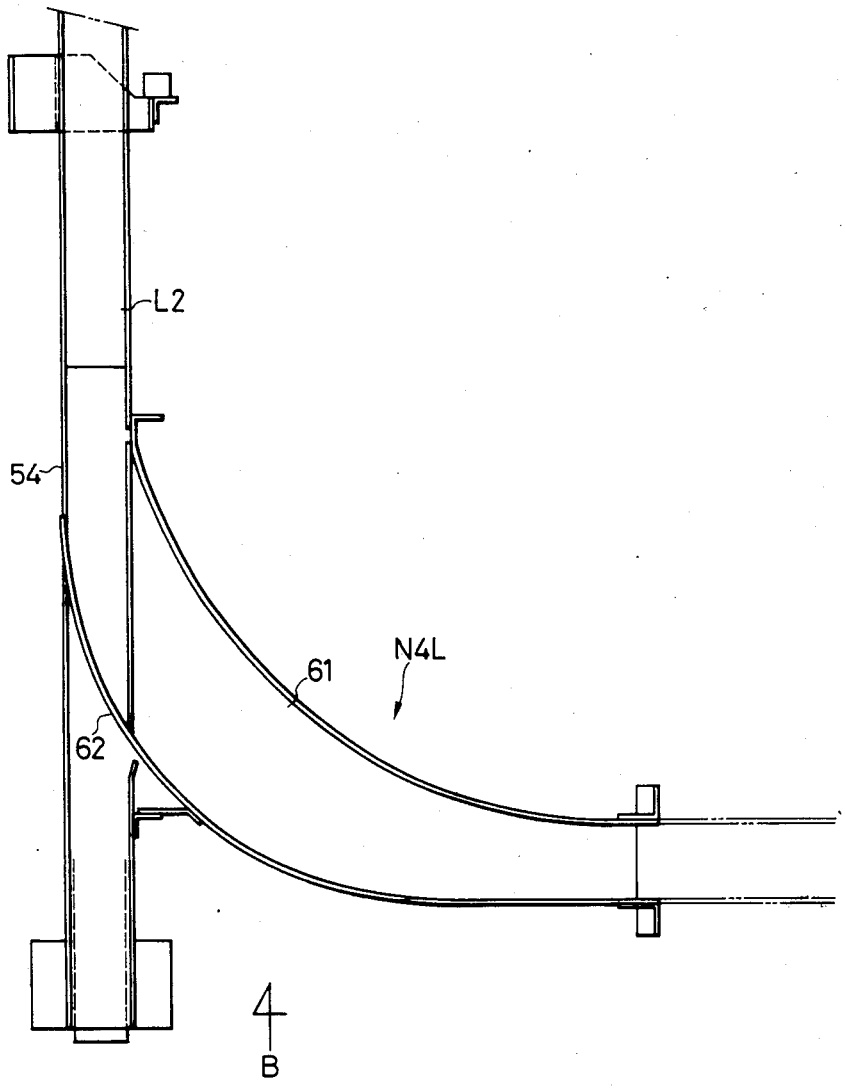
FIG. 10 is a plan view illustrating a branch line at a last end portion of the empty bobbin main line.

FIGS. 10 and 11 illustrate the last branch line N4L in the spinning frame area. Since there is no empty bobbin which advances beyond the branch line N4L, there is no need of provision of a movable guide and a connecting portion of the main line L2 to the branch line N4L is always in an admitting position. In particular, one side plate 62 of the inlet chute 61 is formed to extend above and across the line L2 to the guide plate 54. It is to be noted that, in some cases, it is also possible to provide a movable guide for the connecting portion of the branch line N4L similarly to the movable guide provided for the branch line N1R so that, either when excessive empty bobbins appear or when bobbins with remaining yarns thereon are detected by a detecting device additionally provided for detecting a bobbin with a remaining yarn, such bobbins may be discharged outside the system.

Figure 12:
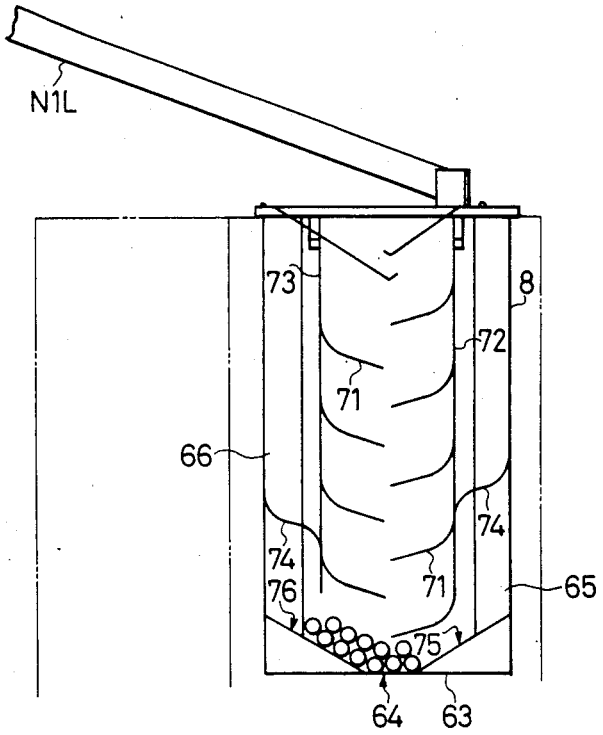
FIG. 12 is a front elevational sectional view illustrating an embodiment of an empty bobbin storing device on the spinning frame side.
Figure 13:
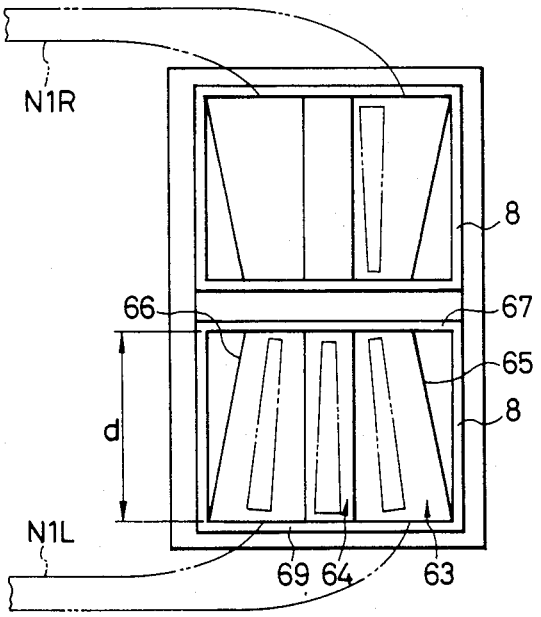
FIG. 13 is a plan view of a box of the empty bobbin storing device of FIG. 12.
Figure 14:
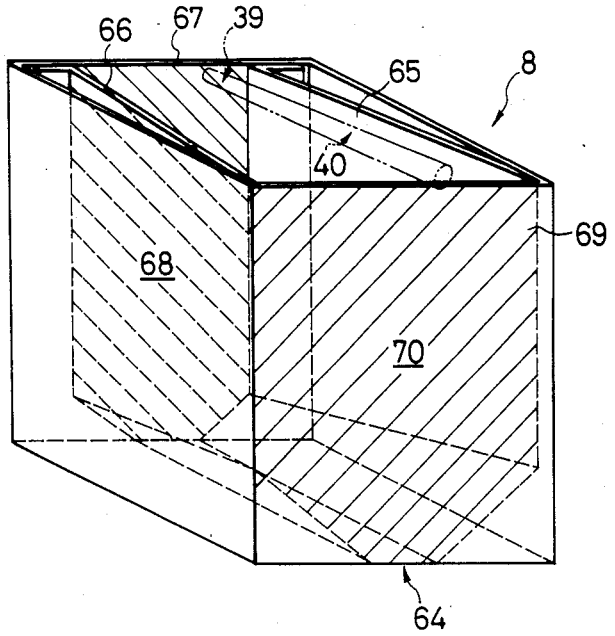
FIG. 14 is a perspective view of the box of FIG. 13.

The bobbin box 8 as shown in FIGS. 12 to 14 is located adjacent a lower end of each of the branch lines N1R to N4L. The box 8 is provided for the R stand and the L stand of the spinning frame SP as illustrated in FIG. 2 and is located at an end on the spinning bobbin discharging side. The empty bobbin box 8 is in the form of a box having a distance of a width (d) substantially equal to the length of an empty bobbin and has four sides and a bottom while an opening for admitting a bobbin is provided at the top of the box and is connected to a lower end of the above described branch line N1R to N4L. The bottom 63 has formed at the center thereof a passing window 64 which allows a bobbin to pass therethrough, and a known empty bobbin fitting device 9 for releasing an empty bobbin and for fitting it onto a peg on the transport band is provided in contiguous relationship.to the passing window 64.

Fixedly mounted within the box 8 are inclined guide plates 65 and 66 for preventing collapse of layers of bobbins arising from differentiated diameters at heads and bottoms of tapered bobbins accumulated in layers. In particular, it is assumed that, as shown in FIGS. 13 and 14, an area of a trapezoidal section 68 of a side plate 67 adjacent bobbin heads 39 delineated by guide plates 65 and 66 and shadowed by leftwardly upwardly inclined lines is represented by S1, and an area of another trapezoidal section 70 of a side plate 69 adjacent bobbin bottoms 40 delineated by the guide plates 65 and 66 and shadowed by rightwardly upwardly inclined lines is represented by S2. Meanwhile, the guide plates 65 and 66 are mounted to meet a following equation $$S1:a = S2:b$$

where a sectional area of a bobbin at an end of the head perpendicular to an axis thereof is represented by a, and an area at an end of the bottom of the bobbin is represented by b. As a result, even if empty bobbins are accumulated in layers, they will be arranged regularly with tapered faces thereof contacted with each other without disturbing the orientations of the bobbins. Reference numerals 75 and 76 designate each an inclined face for guiding an empty bobbin to the passing window 64. The inclined faces 75 and 76 are provided by bent portions of the inclined guide plates 65 and 66, respectively.

Within the box 8, guide pieces 71 for absorbing shocks and controlling directions of empty bobbins dropping from the chute are secured to flexible bands 72 and 73 such as belts and are arranged in opposing zigzag relationship to each other. The bands 72 and 73 are suspended from the top end of the box and outward opening movement thereof is restricted by spring plates 74. It is to be noted here that the box 8 employed for the system does not require a spacing sufficient to contain bobbins for one sides of the spinning frames and may only require a spacing to contain 20 to 30 percent of the spacing.

Figure 15:
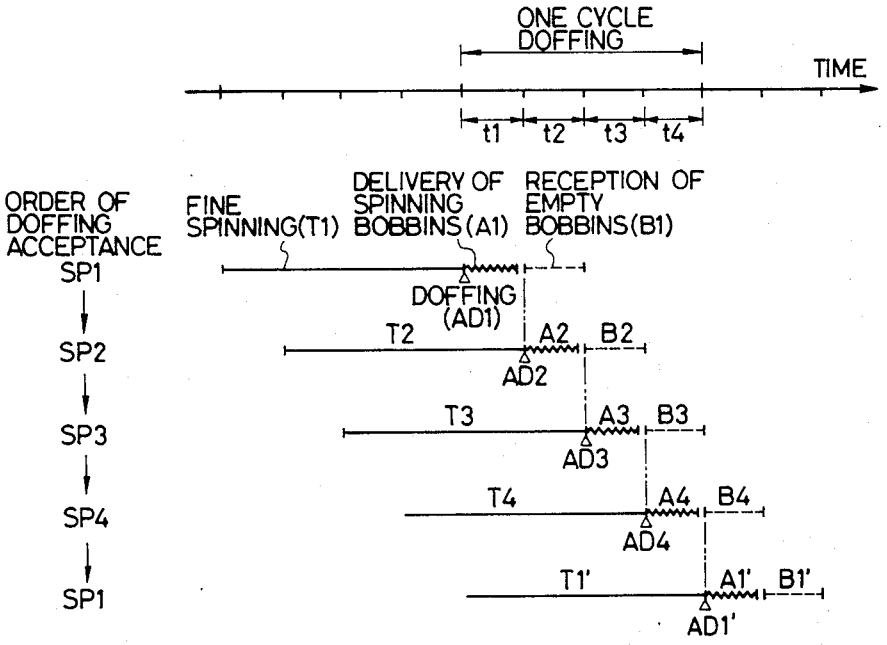
FIG. 15 is a timechart illustrating transportation of bobbins by the system of the invention.

Operations of the bobbin transporting system having such a construction as described hereinabove will be described now. FIG. 15 shows a general timechart. In particular, in the present embodiment, four spinning frames SP1 to SP4 are provided for one winder, and a spinning time of one spinning frame, that is; a time required to wind up spinning yarns of a predetermined quantity onto empty bobbins is defined as a doffing time T while the doffing time T equally divided into four is represented by t1 to t4. According, $t1=t2=t3=t4=\frac{1}{4}T$. The travelling speed of the transport bands 1 and 2 on the spinning frame side is associated with the time, and thus balancing is considered such that all of spinning bobbins doffed by one spinning frame are delivered within the time t while supply of corresponding empty bobbins is completed within the time.

Directly after a spinning time T1 has passed at the spinning frame SP1, doffing AD1 is started thereat so that empty bobbins on the transport bands waiting along the spinning frame are exchanged for spinning bobbins on the spindles of the spinning frame thereby to allow spinning operation to be continued thereafter. Then, a delivering operation is started to supply the spinning bobbins placed on the transport bands to the winder. In this way, spinning bobbins of the spinning frame SP1 are all delivered onto the main bobbin transporting main line L1 within the time t1. During this time, spinning bobbins are delivered from the transport bands of the spinning frame SP1 while empty bobbins are not supplied onto the transport bands. Further, only upon starting of the system, empty bobbins returned from the winder during delivering of spinning bobbins are discharged outside the system without being returned to the spinning frame. In particular, after empty bobbins delivered from the winder during delivering A1 of spinning bobbins have been pulled off their carriers at the bobbin removing station 26 of FIG. 2, they are put into the bobbin box located in the neighborhood of the bobbin removing station 26 without being fed to the transporting line 52.

Then, after doffing AD2 has been completed at the spinning frame SP2 after the spinning time T2, delivering A2 of spinning bobbins is started in the same manner as described above. In particular, upon initiation of the time t2, returning of empty bobbins to the spinning frame SP1 from which spinning bobbins have been completely delivered is started. When returning of empty bobbins to the spinning frame SP1 is completed in the time t2, delivering of spinning bobbins from the spinning frame SP2 is completed. Further, returning of empty bobbins to the spinning frame SP2 is started substantially at the same time with initiation of delivering A3 of spinning bobbins after doffing at any other spinning frame which accepted such doffing, for example, the spinning frame SP3. In this manner, returning of empty bobbins to a designated spinning frame is effected at the same time with initiation of delivering of spinning bobbins at any other spinning frame except the designated spinning frame. In other words, while spinning bobbins are fitted onto pegs on the transport bands in a spinning frame, empty bobbins are returned from the winder to the spinning frame.

Here, delivering of spinning bobbins need necessarily be completed within the time ti, that is, within the $\frac{1}{4}\cdot T$ time for one spinning frame, and hence delivering need be completed with the time T for the four spinning frames, as seen from FIG. 15. In particular, since the winder and the spinning frames are directly connected with the processing capacity of the former balanced with the yarn producing capacity of the latter, all of spinning bobbins produced within the one doffing time T are rewound within the same time T by the winder. Accordingly, if the times A1 to A4 required for delivering of spinning bobbins are each longer than the time $\frac{1}{4}\cdot T$, then a sum total of such times required for delivering spinning bobbins from all of the four spinning frames becomes greater than the time T and hence spinning bobbins may not be supplied some winding units of the winder. It is to be noted that it is premised here that delivering of spinning bobbins is not performed by a plurality of spinning frames at a time. In other words, if spinning bobbins are delivered from a plurality of spinning frames at a time, such spinning bobbins may interfere with each other on the main line L1, resulting in jamming by the spinning bobbins. Or otherwise, since spinning bobbins are accepted at one place by the winder, control of feeding of spinning bobbins may be complicated. Consequently, according to the system described above, since returning of empty bobbins to a spinning frame is started upon initiation of delivering of spinning bobbins from a subsequent next spinning frame, if spinning bobbins are delivered from one spinning frame during delivering of spinning bobbins from another spinning frame, returning of empty bobbins will become impossible, resulting in a trouble in operation of the system.

Accordingly, delivering of spinning bobbins from a spinning frame must be completed with the time described above. Here, by simultaneous delivering of spinning bobbins from the transport bands 1 and 2 on opposite sides of a spinning frame, direct connection of a winder to an already installed spinning frame, especially to a spinning frame the delivering speed from which is slow, is made possible. For example, in case a winder having a processing capacity of 20 units per minute is directly connected to a spinning frame having two transport bands each having a delivering speed of 16 units per minute as described hereinabove, if the two transport bands are circulated in integral relationship or at a same time, then the spinning bobbin delivering speed of the spinning frame becomes 32 units per minute, which is greater than the processing capacity of the winder so that there will be no need of having a waiting on the winder side. It is to be noted that, in case both transport bands are circulated in integral relationship in this manner, if the transport bands are operated in response to a spinning bobbin demanding instruction from the winder side, excessive or surplus supply of spinning bobbins to the winder can be avoided in the case described above. In other words, a waiting time will appear on the transport band side. However, such a waiting time does not become an obstacle to the transporting system and can be utilized, in a sense, as an adjusting time for the spinning bobbin supplying speed. Thus, for example, a spinning bobbin delivering time A1 of FIG. 15 is a sum total of a time for actually circulating the transport bands 1 and 2 to deliver spinning bobbins and a waiting time during which circulation of the transport bands 1 and 2 is stopped.

It is to be noted that a spinning bobbin demanding instruction from the winder may be a transport band circulating signal, for example, from a feeler which operates when spinning bobbins stored in a bobbin stocker of the spinning bobbin supplying device of FIG. 2 are consumed to a preset quantity. Such a preset quantity is determined such that spinning bobbins remaining in the stocker is not reduced at least to zero while spinning bobbins delivered from the transport bands are transported on the transporting line to the spinning bobbin supplying station 27.

Thus, according to the system, since spinning bobbins are delivered two by two from a spinning frame, a high speed automatic winder can be directly connected to an already installed spinning frame which has a low circulating speed only with one of two transport bands and hence cannot otherwise provide good balancing in supply and consumption of bobbins with the winder.

An order for spinning bobbins to be transported is determined depending upon an order of doffing completion signals developed from a plurality of spinning frames, and after spinning bobbins produced by the first spinning frame, that is, the spinning frame which first developed a doffing completion signal, have all been transported to the winder, spinning bobbins produced by the next spinning frame are transported while empty bobbins from which yarns have been unwound are returned to the spinning frame which has completed delivering of spinning bobbins therefrom.

It is to be noted that delivering of spinning bobbins from the spinning frames is effected such that the R and L stands of a spinning frame each deliver one spinning bobbin, that is, a total of two spinning bobbins at a time therefrom as seen from FIGS. 5*a*, 5*b* and 6. The two spinning bobbins FB1 and FB2 are then placed separately to two positions on the inclined conveyor M by way of the chutes 29 and 30 and are then fed upwardly as the conveyor M is circulated. They are then transferred to the transporting main line L1 so that they are transported to the spinning bobbin supplying device 27 on the winder side shown in FIG. 7.

Meanwhile, returning of empty bobbins to a designated spinning frame is effected such that empty bobbins are returned one by one alternately to the bobbin boxes of the R and L stands (SPR and SPL) of the spinning frame. In particular, referring to FIG. 16, in case empty bobbins are to be returned, for example, to the spinning frame SP1, empty bobbins FB1 which are carried thereto on the empty bobbin transporting main line L2 are fed alternately into the branch lines N1R and N1R under the control of the movable guides 60R and 60L provided adjacent the connecting portions of the branch lines N1R and N1L of the spinning frame SP1. In particular, upon starting of returning of empty bobbins to the spinning frame SP1, the movable guide 60L for the L stand, that is, for the branch line N1L on the downstream of side the main line L2 is positioned to its full line position by operation of the rotary solenoid SO1L. The movable guide 60L is thereafter held to the full line position until completion of returning of empty bobbins to the spinning frame. Accordingly, if the movable guide 60R for the R stand side located on the upstream side of the main line L2 is shifted alternately into the open and closed positions each time an empty bobbin is fed thereto on the main line L2, empty bobbins will be fed alternately into the branch lines N1R and N1L.

Such controlling is effected in response to on/off signals from the sensors PH044 and PH045 located directly before the branch paths, that is, signals representative of presence or absence of an empty bobbin.

Figure 16:
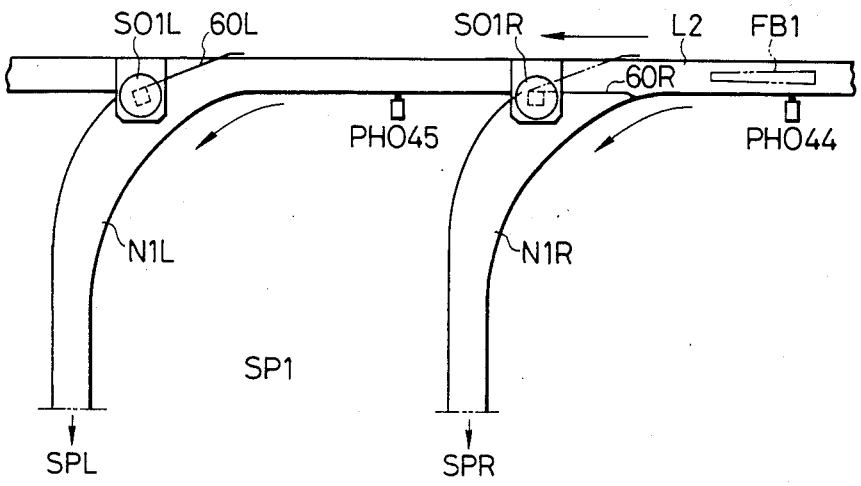
FIG. 16 is a schematic view illustrating an empty bobbin sorting operation.
Figure 17:
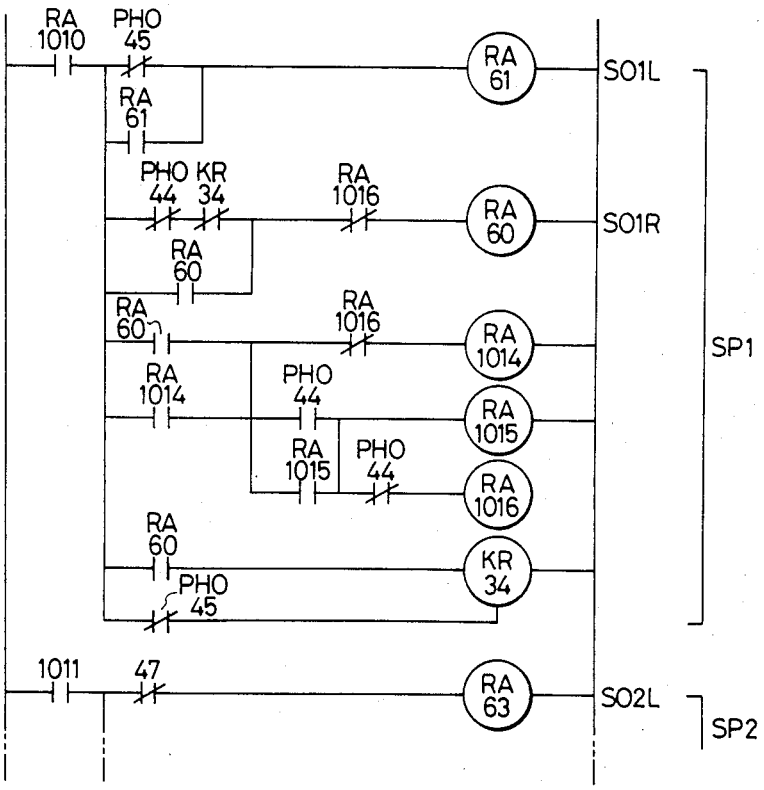
FIG. 17 is a circuit diagram of an example of a sequencing circuit for controlling the empty bobbin sorting operation.

The alternate feeding of empty bobbins as mentioned hereinabove is attained by means of a sequencing circuit such as, for example, illustrated in FIG. 17. Now, if delivery of spinning bobbins from the spinning frame SP1 is completed and then reverse circulation of the transport bands for accepting empty bobbins from the spinning frame SP1 is started together with delivery of spinning bobbins from any other spinning frame, a reverse circulation signal is inputted from the spinning frame side to the control section so that a contact RA1010 for the spinning frame SP1 of FIG. 17 is closed. As a result, a relay RA61 for the solenoid SO1L is closed so that the movable guide 60L on the downstream side of FIG. 16 is shifted to the full line position thereby to close an a contact RA61 of the relay RA61, thus forming a self holding circuit. Consequently, the movable guide 60L is maintained in a position extending into the main line L2 until after completion of returning of empty bobbins.

In this condition, when an empty bobbin FB1 comes to a position adjacent the sensor PH044, a b contact PH044 for the solenoid SO1R is closed to energize the relay RA60 so that the rotary solenoid SO1R is operated and shifted to a phantom position of FIG. 16 and is thereafter self held by an a contact RA60 thereof. Accordingly, even if a contact KR34 of a keep relay KR34 is opened, the movable guide is still held closed even after an empty bobbin FB1 has passed by the position adjacent the sensor PH044 so that the empty bobbin FB1 will be guided into the chute N1R for the R stand of the spinning frame.

As the empty bobbin FB1 passes by the position adjacent the sensor PH044, the a contact is closed to energize a relay RA1015 so that an a contact RA1015 thereof is closed. In this condition, as a next empty bobbin comes to the position adjacent the sensor PH044, a b contact PH044 for another relay RA1016 is closed to energize the relay RA1016 so that a b contact RA1016 thereof is closed. As a result, the relay RA60 is deenergized so that the solenoid SO1R is returned to the full line position of FIG. 16, allowing succeeding empty bobbins to be fed on the main line L2 and then into the branch line N1L without being fed into the branch line N1R. At this instant, when an empty bobbin passes by the position adjacent the sensor PH045, the b contact PH045 is closed to reset the keep relay KR34 so that the relay contact KR34 for the relay SO1R is closed. Then, if a next empty bobbin comes to the position adjacent the sensor PH044, the solenoid SO1R is energized to cause the movable guide 60 to extend into the main line L2 in the same manner as described hereinabove.

In this manner, each time an empty bobbin reaches, the rotary solenoid SO1R is shifted alternately into the open and closed positions to thus sort empty bobbins fed on the main line L2 alternately into the branch lines N1R and N1L.

Such sorting is effected quite in the same manner for the spinning frames SP2 and SP3, but since the spinning frame SP4 has no rotary solenoid for the L stand thereof, the movable guide for the R stand effects opening and closing operations quite in the same manner except that there is no circuit which corresponds to a line of the relay RA61 for the SO1L of FIG. 17.

Figure 18:
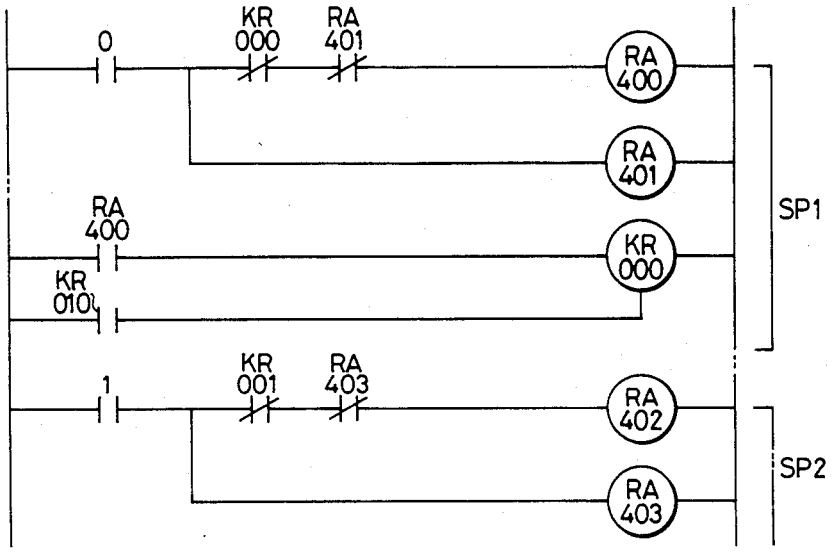
FIGS. 18 to 20 are views illustrating an example of a sequencing circuit for controlling spinning bobbin delivering operations and empty bobbin returning operations according to the system of the invention.
Figure 20:
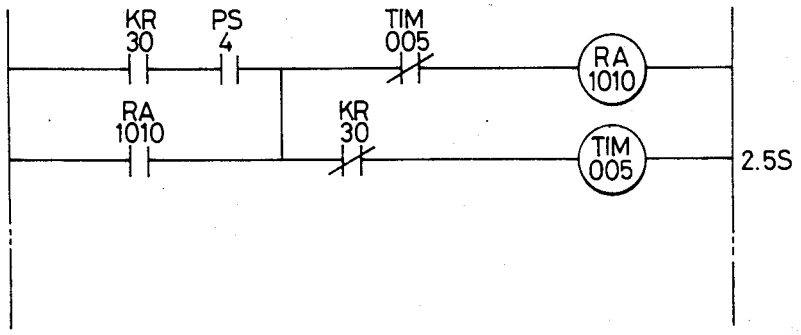
Figure 19:
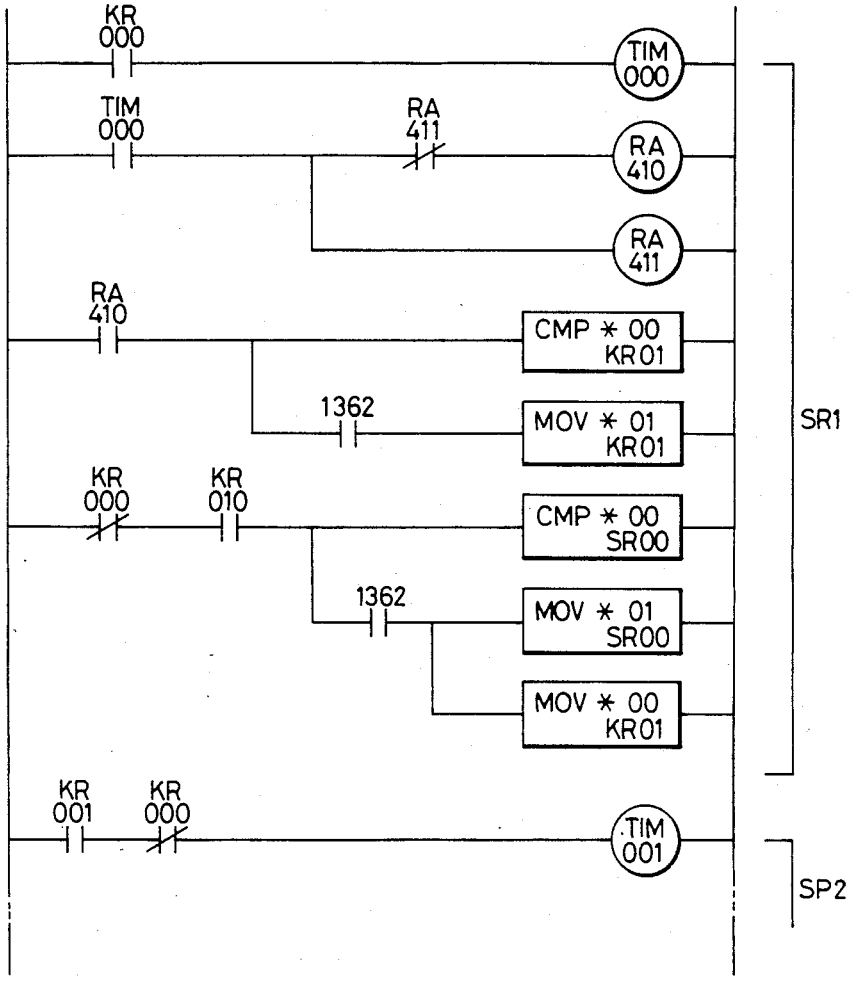

Essential part of the sequencing circuit from doffing to acceptance of empty bobbins at the spinning frames SP1 to SP4 is illustrated in FIGS. 18 to 20.

Referring to FIG. 18, as doffing is completed, for example, at the spinning frame SP1, a contact 0 is closed to accept registration of transportation of spinning bobbins and an acceptance signal is inputted to one of shift registers corresponding to the spinning frame SP1. In particular, as the a contact 0 is closed in response to a doffing completion signal developed from the spinning frame SP1, a relay RA400 is energized to set a keep relay KR000 via the a contact RA400 so that a contact KR000 of FIG. 19 is closed to energize a timer relay TIM000. Besides, a contact RA410 is closed via a contact TIM000 and a relay RA410 to allow a spinning bobbin transportation registration acceptance signal to be inputted to the shift register (KR001). In case doffing completion signals are outputted from the spinning frames, they are inputted in accordance with an order of times of completion of doffing. Accordingly, if a spinning bobbin transportation registration acceptance signal, for example, of the spinning frame SP1 is inputted by way of the keep relay KR000, a contact of an acceptance circuit on the spinning frame SP2 side is opened, and as a result, if the contact KR001 is closed in response to the doffing completion signal of the spinning frame SP2, the relay TIM001 is not energized while the contact KR000 is closed when the keep relay KR000 is reset after completion of transportation of spinning bobbins of the spinning frame SP1. As a result, since the contact KR001 is held closed if at this instant a doffing completion signal is being developed from the spinning frame SP2, the spinning bobbin transportation registration acceptance signal of the spinning frame SP2 is inputted to the shift register whereafter delivery of spinning bobbins from the spinning frame SP2 is initiated. Accordingly, spinning bobbins can never be delivered from two spinning frames, for example, SP1 and SP2, at a time.

Further, referring to FIG. 20, at the spinning frame SP1, a contact KR30 for allowing acceptance of empty bobbins is closed in response to completion of delivery of spinning bobbins. As the transport bands start their reverse circulation to thus begin operations to fit empty bobbins stored in the bobbin boxes in prior onto pegs on the transport bands, an a contact 4 of FIG. 20 is closed to energize a relay RA1010 so that the contact RA1010 of FIG. 17 mentioned hereinabove is closed to effect a storing operation for empty bobbins. After supply of empty bobbins onto the transport bands has been completed, the keep relay KR30 is reset so that a b contact KR30 is closed. As a result, by a timer relay TIM005, a b contact TIM005 is opened to deenergize the relay RA1010 so that a contact RA1010 of FIG. 17 is opened to stop sorting of empty bobbins to the spinning frame SP1, thus making preparations for acceptance of empty bobbins to a spinning frame to be designated subsequently.

It is to be noted that the circuits shown in FIGS. 17 to 20 are illustrated only for the spinning frame SP1, and similar circuits are also provided for the other spinning frames.

Figures 1, 21:
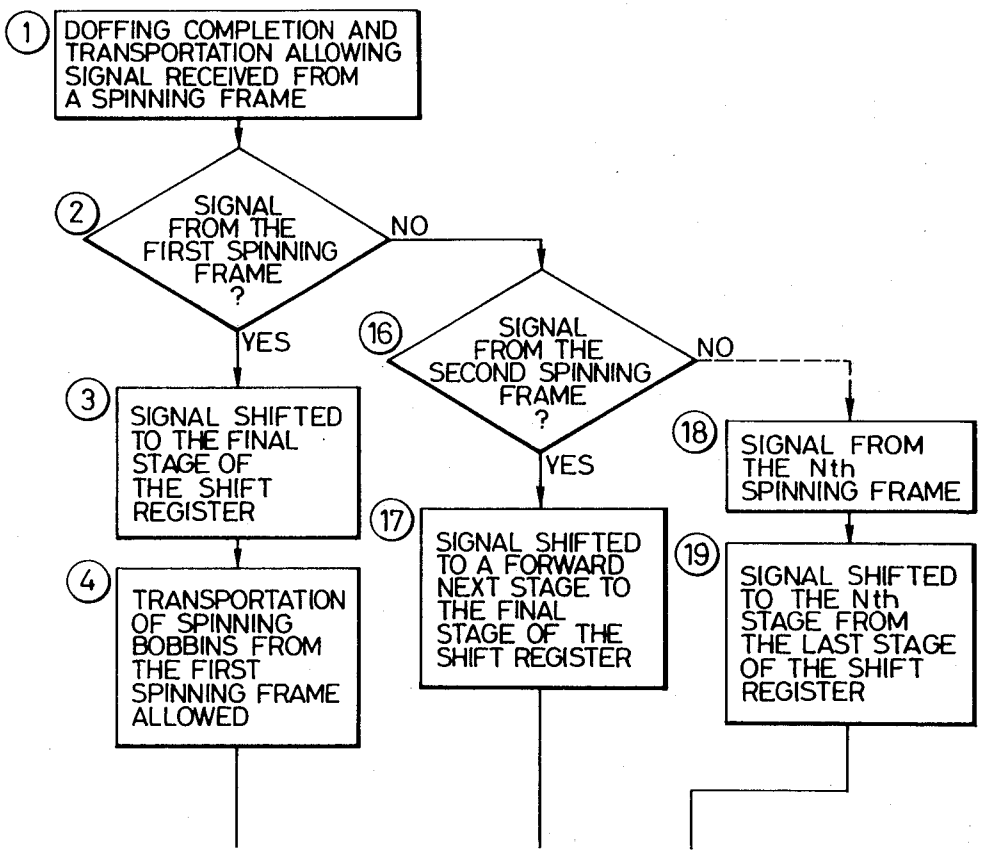
Figures 2, 21:
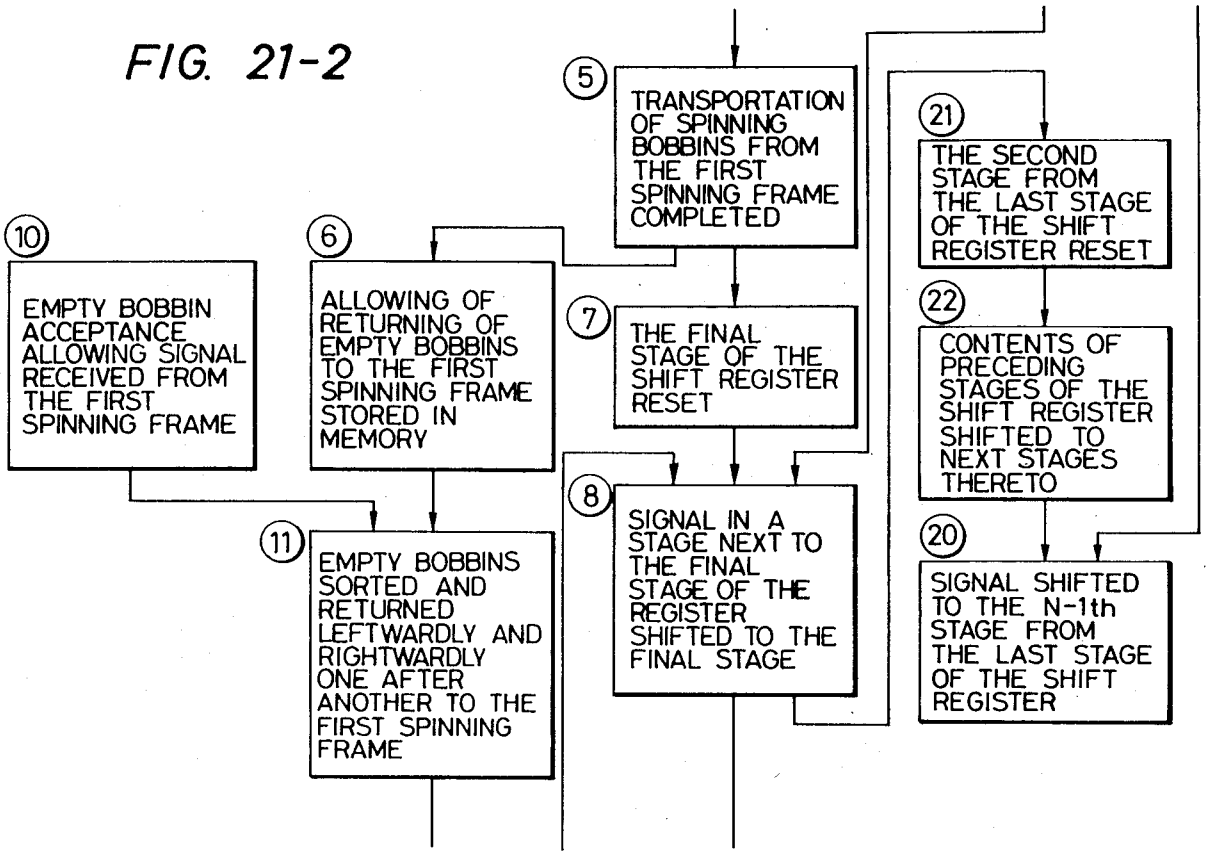
Figures 3, 21:
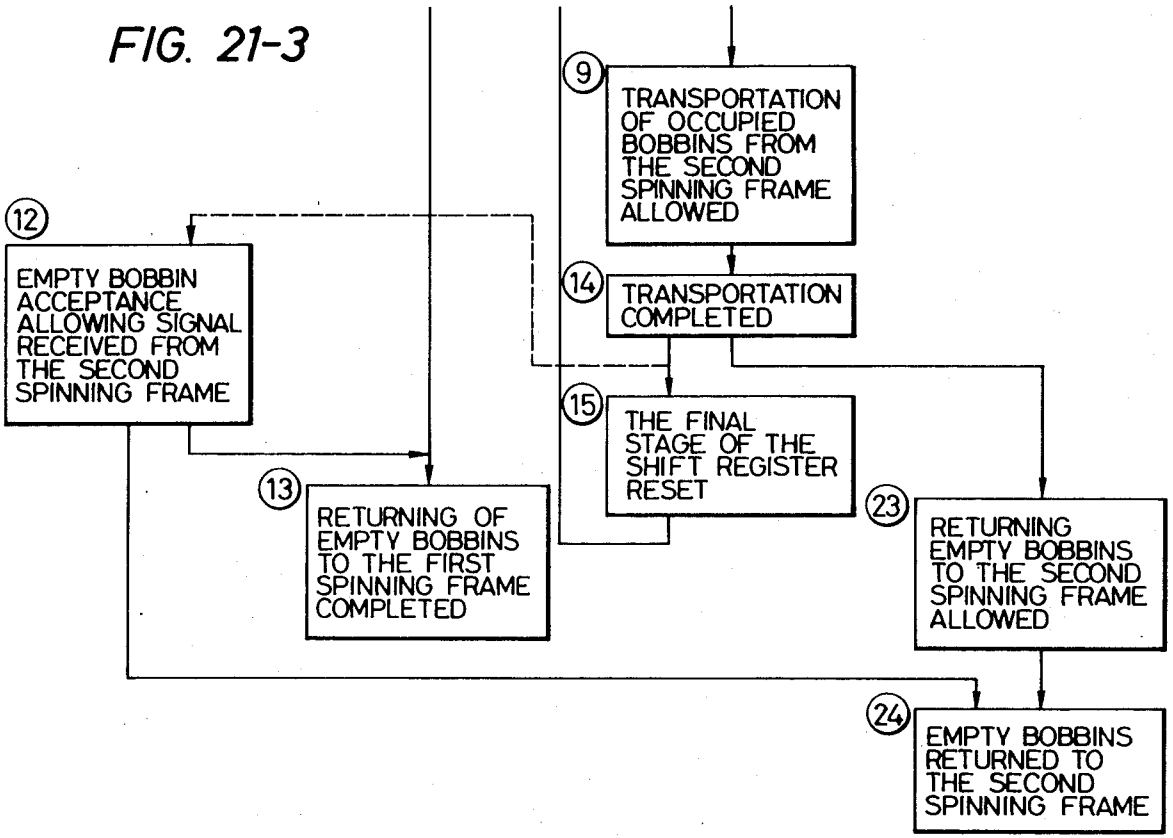

FIGS. 21-1 to 21-3 show a flowchart of spinning bobbin delivering and empty bobbin supplying operations.

In particular, a controlling circuit is constituted using a shift register having a number of stages corresponding to a number of spinning frames which are directly connected to a winder.

If a signal for allowing transportation of spinning bobbins is received from a spinning frame (steps 1 and 2), signals are shifted one after another to a final stage of the shift register beginning with a signal from a first spinning frame (step 3). Thus, transportation of a spinning bobbin for the spinning frames is controlled at a bit position of the signal at the final stage of the shift register (step 4).

Thereafter, doffing completion signals received from a second spinning frame are shifted to a stage next to the final stage of the shift register (Steps 16 and 17). Similarly, later received doffing signals from the Nth spinning frame are shifted to the Nth stage from the final stage of the shift register (Steps 18 and 19).

After completion of the transportation of spinning bobbins by the first spinning frame (Step 5), such completion is stored into memory (Step 6) and the final stage of the shift register is reset (Step 7). After such resetting, contents of a stage next to the final stage of the shift register are shifted to the final stage (Step 8). In addition, the second stage from the last stage of the shift register is reset (Step 21), the contents of preceding stages of the shift register are shifted one step closer to the final stage (Step 22) and the signals in the Nth stages are shifted to the Nth stages (Step 20). Transportation of a spinning bobbin for the second spinning frame is started (Step 9) as the signal from the second spinning frame is in the spinning stage. Simultaneously, an empty bobbin acceptance signal is received by the first spinning frame (Step 10) and empty bobbins are returned to the first spinning frame (Step 11). When transportation of spinning bobbins from the second spinning frame is completed (Step 14), the transportation of empty bobbins to the first spinning frame is deemed completed (Step 13).

The final stage of the shift registered is then reset (Step 15), the signal in the second to the final stage of the shift register is shifted to the final stage (Step 8), the second from the last stage of the shift register is reset (Step 21), the contents of preceding stages of the shift register are shifted to their next stages (Step 22), and the signal in the last stage of the shift register is shifted to the N-1th stage (Step 20)

After shifting is completed, the signal from the spinning frame which generated a doffing completion signal after the second frame is located in the final stage. This spinning frame will then be in a position to transport spinning bobbins. Simultaneously, an empty bobbin allowing signal will be received from the second spinning frame (Step 12). Empty bobbins will be then allowed to return to the second spinning frame (Steps 23 and 24).

Thus, transportation of spinning bobbins from and returning of empty bobbins to a plurality of spinning frames are performed in a similar manner.

As apparent from the foregoing description, in a bobbin transporting system according to the present invention, a winder and spinning frames are connected to each other by means of a bobbin transporting line while bobbin feeding transport bands located along opposite sides of the spinning frames are connected to each other so as to circulate them in integral relationship whereby spinning bobbins are delivered at the same time from the transport bands to a spinning bobbin transporting line which is connected to the winder. Accordingly, while a delivering speed by one of the two transport bands has been lower than a spinning bobbin processing speed of the winder, the delivering speed of a spinning frame can be balanced with the spinning bobbin processing speed of the winder without raising the circulating speed of the transport bands, that is, without reconstructing the spinning frame at all, and hence direct connection between an already installed spinning frame and a winder is made possible without causing a waiting time on the winder side.

Furthermore, according to a system of the present invention, a winder area and a spinning frame area having a plurality of spinning frames therein are interconnected to each other by means of a spinning bobbin transporting line and an empty bobbin transporting line such that returning of an empty bobbin to a designated one of the spinning frames in the spinning frame area is effected while spinning bobbins doffed from any other designated spinning frame except the designated spinning frame are being delivered onto the spinning bobbin transporting line. Accordingly, the present invention has a particularly remarkable effect where, due to the construction of a spinning frame, it is impossible to return empty bobbins to the spinning frame during delivery of spinning bobbins, or where ever if it is possible, it is necessary to provide an empty bobbin storing device which can store therein a number of empty bobbins corresponding to a number of spindles of the spinning frame. In particular, since empty bobbins are directly returned from a winder to a given spinning frame while an empty bobbin supplying operation of the spinning frame onto a transport band is being performed, empty bobbins to be returned are supplied onto the transport band at any time. Accordingly, there is no necessity of provision of an empty bobbin storing device having a large capacity, and besides, automatic transportation between the winder and the spinning frame or frames is made possible without the necessity of extensive modification to any spinning frame already installed.

In addition, a position at which empty bobbins are supplied to a spinning frame can be set to the same side with the spinning bobbin delivery side of the spinning frame, resulting in considerable reduction of an empty bobbin transporting line when compared to a system in which an empty bobbin supplying station is located on a side opposite to the spinning bobbin delivery side.

What is claimed is:

1. A bobbin transporting system for transporting empty bobbins and spinning bobbins comprising:

a winder;

a spinning frame;

transportion means located adjacent said spinning frame for transporting empty bobbins to and spinning bobbins from said spinning frame;

a spinning bobbin transporting path located between said transportation means and said winder for transporting spinning bobbins therebetween;

an empty bobbin transporting path located between said winder and said transportation means for transporting empty bobbins therebetween; and drive means for driving said transportation means in a first direction of operation to receive empty bobbins from said empty bobbin transporting path and for driving said transportation means in a second direction of operation to deliver spinning bobbins to said spinning bobbin transporting path.

2. A bobbin transporting system as claimed in claim 1, further comprising:

delivery means for delivering empty bobbins to said transportation means from said empty bobbin transporting path when said transportation means is driven in said first direction of operation.

3. A bobbin transporting system comprising:

a plurality of spinning frame;

a winder;

transportation means located adjacent each of said spinning frames for transporting empty bobbins to and removing spinning bobbins from said spinning frames;

means for transporting empty and spinning bobbins between said transportation means and said winder;

means for driving said transportation means in a first direction to receive spinning bobbins from said spinning frames and in second direction to deliver empty bobbins to said spinning frames, and the doffing time of each spinning frame being equal to or less than:

$$1/n \cdot T$$

n = total number of spinning frames, and

T = total doffing time for the n spinning frames.

4. A bobbin transporting system comprising:

a winder;

a spinning frame;

transportation means adjacent said spinning frame for transporting spinning bobbins and empty bobbins along a path adjacent to said spinning frame; and means for transporting spinning and empty bobbins between said transportation means and said winder;

wherein said transportation means operates to transport empty bobins in a first direction along the path and is reversible in operating direction to transport spinning bobbins in an opposite direction along the path.

5. A bobbin transporting system as claimed in claim 4, wherein said bobbin transporting means further comprises:

a spinning bobbin transportation path for transporting spinning bobbins from said transportation means to said winder; and an empty bobbin transportation path for transporting empty bobbins from said winder to said transportation means.

6. A bobbin transporting system as claimed in claim 5, further comprising:

means adjacent said transportation means for preventing passage of more than one spinning bobbin at a time onto said spinning bobbin transporting path.

7. A bobbin transporting system as claimed in claim 4, wherein said transportation means comprises a conveyor.

8. A bobbin transportation system comprising:

a winder;

a first spinning frame;

a second spinning frame;

first transport means adjacent said first spinning frame for receiving spinning bobbins from said first spinning frame and delivering empty bobbins to said first spinning frame;

second transport means adjacent said second spinning frame for receiving spinning bobbins from said second spinning frame and delivering empty bobbins to said second spinning frame;

a spinning bobbin transporting path for transporting spinning bobbins from said first transport means and said second transport means to said winder;

an empty bobbin transporting path for transporting empty bobbins from said winder to said first transport means and said second transport means;

first drive means for driving said first transport means in a first direction during receipt of said spinning bobbins from said first spinning frame and in a second direction during delivery of empty bobbins to said first spinning frame; and second drive means for driving said second transport means in a first direction during receipt of spinning bobbins from said second spinning frame and in a second direction during delivery of empty bobbins to said second spinning frame.

9. A bobbin transporting system according to claim 8, wherein said first and second transport means each contain a first and second end, said first end being located adjacent both said spinning bobbin transporting path and said empty bobbin transporting path.

10. A bobbin transporting system according to claim 8, further comprising:

means for activating said first transport means to deliver empty bobbins to said first spinning frame upon completion of delivery of spinning bobbins from said first spinning frame to said spinning bobbin transport path by said first transport means.

11. A bobbin transporting system according to claim 8 further comprising:

means for activating said second transport means to deliver spinning bobbins to said spinning bobbin transport path upon completion of delivery of spinning bobbins to said spinning bobbin transport path by said first transport means.

12. A bobbin transportation system comprising:

a winder;

a first spinning frame;

a second spinning frame;

first transport means adjacent said first spinning frame, said first transport means being operable in one direction along a first path for receiving spinning bobbins from said first spinning frame and in a reversed direction along the first path for delivering empty bobbins to said first spinning frame, said first transport means having a first and second end;

second transport means adjacent said second spinning frame, said second transport means being operable in one direction along a second path for receiving spinning bobbins from said spinning frame and in a reversed direction along the second path for delivering empty bobbins to said first spinning frame, said second transport means having a first and second end; and a bobbin transporting path for transporting empty and spinning bobbins between said winder and said first end of said first and second transport means.

* * * * *